United States Patent [19]

Holsten et al.

[11] Patent Number: 4,979,260

[45] Date of Patent: Dec. 25, 1990

[54] HAND-GUIDED SWEEPING MACHINE

[75] Inventors: Heinz Holsten, Fintel; Joachim Bahnemann, Bad Oldesloe, both of Fed. Rep. of Germany

[73] Assignee: Hako-Werke GmbH, Bad Oldesloe, Fed. Rep. of Germany

[21] Appl. No.: 285,090

[22] Filed: Dec. 15, 1988

[30] Foreign Application Priority Data

Dec. 16, 1987 [EP] European Pat. Off. ..... 87118654

[51] Int. Cl.[5] ..... A47L 5/14

[52] U.S. Cl. ..... 15/349; 15/340.3; 15/83; 15/79.2

[58] Field of Search ..... 15/83, 74 A, 340.3, 15/349

[56] References Cited

U.S. PATENT DOCUMENTS

| | | | |
|---|---|---|---|
| 2,701,377 | 2/1955 | Luissch et al. | 15/83 X |
| 2,782,435 | 2/1957 | Stone | 15/79 A X |
| 2,784,440 | 3/1957 | Newport | 15/340.3 |
| 2,834,034 | 5/1958 | Angell | 15/349 X |
| 2,910,720 | 11/1959 | Smith | 15/349 X |
| 4,173,052 | 11/1969 | Burgoon et al. | 15/349 X |
| 4,716,621 | 1/1988 | Zoni | 15/349 |

*Primary Examiner*—Frankie L. Stinson
*Attorney, Agent, or Firm*—Foley & Lardner

[57] ABSTRACT

A hand-guided sweeper employing a rotary brush to propel debris into a detachable hopper, a blower to facilitate pickup of dust and a filter to remove dust prior to passing through the blower includes guides on the frame of the sweeper adapted to cooperate with projections on the sides of the hopper, permitting the hopper to be inserted and removed from the front of the sweeper without notable lifting and interference to the blower and filter.

19 Claims, 7 Drawing Sheets

HAND-GUIDED SWEEPING MACHINE

BACKGROUND OF THE INVENTION

1. Field of the Invention

The present invention relates to hand-guided sweeping machines, and, particularly, to sweeping machines of the type employing a rotary-driven cylindrical brush to propel debris into a detachable hopper, a blower (fan) for drawing a suction airstream through the machine to facilitate pickup of dust, and a filter disposed to remove dust from the airstream prior to passing through the blower.

2. Description of the Prior Art

In general, hand-guided sweeping machines including a removable hopper disposed to receive debris propelled by a rotary-driven cylindrical brush and a fan for drawing a suction airstream through the hopper are known. An example of such a prior art sweeper is described in U.S. Pat. No. 2,972,159 issued Feb. 21, 1961, to A. S. Swanson, et al.

It is also known to interpose a filter in the suction air stream with the filter disposed above the hopper so that in such sweepers, particles collected by the filter fall be shaken down into the hopper. An example of such a prior art sweeper is described in U.S. Pat. No. 3,189,931, issued on June 22, 1965, to R. C. Peabody. That sweeper employes an integral filter-hopper unit having stub pivots on its side. The stub pivots are releasably pivotally engaged by hydrolically driven arms on the sweeper frame. When the arms are in a lowered position, the hopper is disposed to receive particles propelled by cylindrical brushes. When the hopper is to be emptied, the hydraulic arms are raised, once the hopper-filter unit pivots under its own weight to dump its contents.

Another example of such a prior art sweeper is described in U.S. Pat. No. 4,580,313, issued on Apr. 8, 1986, to M. L. Blehert. That sweeper employs a box-shaped filter housing disposed immediately above the hopper. The rear upper end of filter housing is hinged to the frame of the sweeper in proximity to the blower inlet and the housing lowered to bring the inlet of the housing into communication with an opening in the top of the hopper. The hopper includes arms which are pivotally mounted to the sweeper frame. The filter housing is pivoted upward into a raised position to permit the hopper to be tipped for emptying or removal from the sweeper.

It is often necessary to empty the hopper at a site that is not accessible to a sweeper, requiring that the hopper be detached from the sweeper. In order to remove the hopper from the prior art devices the hopper must be lifted a significant distance to clear the coupling mechanism. Accordingly, in devices such as described in U.S. Pat. No. 4,580,313, the filter housing must be tilted and raised sufficiently to provide the necessary clearance for lifting the hopper from the machine frame. Further, since the hopper is pivotally mounted to the sweepers in the prior art and is often balanced for pivoting, there is a significant risk that the hopper will inadvertently be tipped prematurely, dumping its contents during the removal procedure. Such inadvertant spillage assumes additional significance since the filter housing is either unitary with the hopper, or is tilted and raised to provide clearance for the hopper. The filter is effectively removed from the blower intake, reducing the blow susceptible to dust and particles raised during the removal process.

SUMMARY OF THE INVENTION

The present invention provides a hand-guided sweeping machine of relatively simple construction which permits removal of the hopper without requiring notable lifting and without rendering the blower susceptible to dust and particles raised during emptying.

In accordance with one aspect of the present invention guides slidably engage the sides of the hopper to lift the hopper into position in response to relative movement between the hopper and the sweeper body, e.g., when the sweeper is advanced in the forward direction. In the preferred embodiment, guides, adapted to cooperate with projections on the sides of the hopper, are provided on respective forward side supports of the sweeper frame, permitting the hopper to be inserted, and removed, from the front of the sweeper. A filter housing is deployed above the guide track which cooperates with the hopper when the hopper is engaged on the frame of the sweeper, but does not interfere with movement of the hopper on the guides. The guides include a front section which slopes downward from the rear to the front, and an adjacent section having a considerably smaller slope relative to the ground than the front section (preferably generally parallel to the ground). The hopper, when introduced into the machine frame, thus initially moves upwards, and then backwards with little or no increase in elevation, ultimately brought into cooperation with the filter housing. Thus, no change in position of the filter housing is required to facilitate removal and insertion of the hopper, and the filter remains disposed to protect the blower at all times during removal and insertion of the hopper.

In accordance with another aspect of the present invention, a flap like sealing arrangement surrounding the filter housing inlet opening is provided.

In accordance with still another aspect of the present invention, a gap, recess, or indentation of dimensions in accordance with the dimensions of the front projection is formed on the track to automatically engage the front projection and secure the hopper on the sweeper frame. In the preferred embodiment, the front projection is of lesser dimensions than the rear projection, and disposed at a slightly lower level on the side of the hopper. The gap, or indentation, is disposed at the juncture of the angled front section and, generally, horizontal section of the guide. The larger dimensions of the rear hopper projection permit the rear projection to pass smoothly over the gap or indentation during insertion or removal.

DESCRIPTION OF THE DRAWINGS

A preferred exemplary embodiment will hereinafter be described in conjunction with the appended drawing wherein like numbers denote like elements and.

In various of the Figures, elements are omitted or shown only in schematic form for ease of illustration and clarity.

DETAILED DESCRIPTION OF THE PREFERRED EXEMPLARY EMBODIMENT

Figure 1:
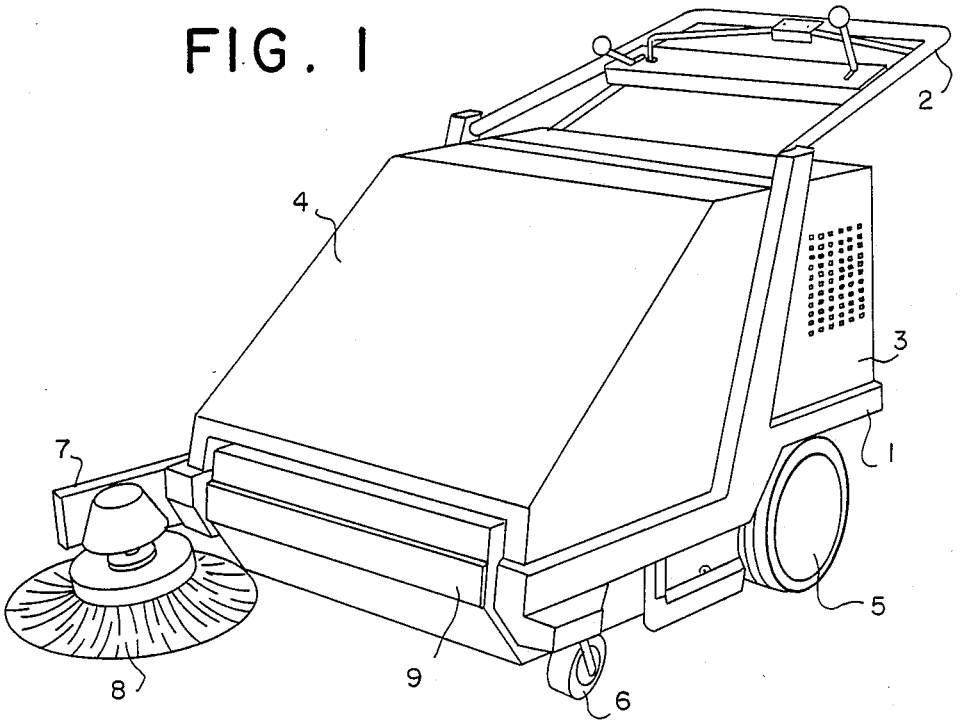
FIG. 1 is a perspective view of a hand-guided sweeping machine according to the invention.
Figure 2:
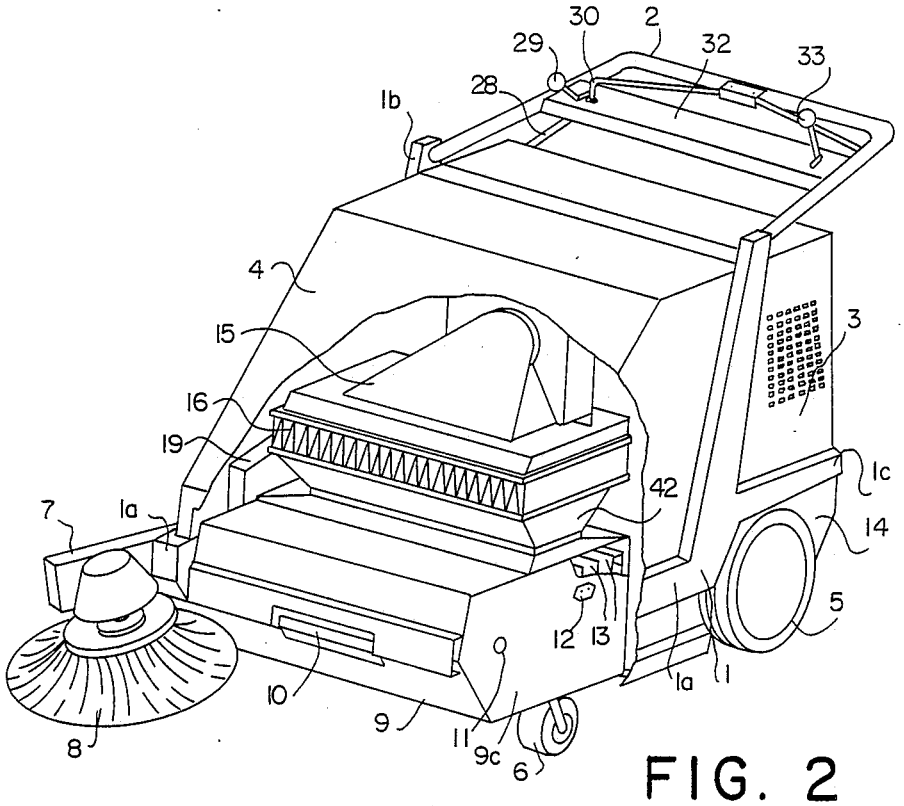
FIG. 2 is a partly cut-away and simplified perspective view of the hand-guided sweeping machine of FIG. 1.
Figure 6:
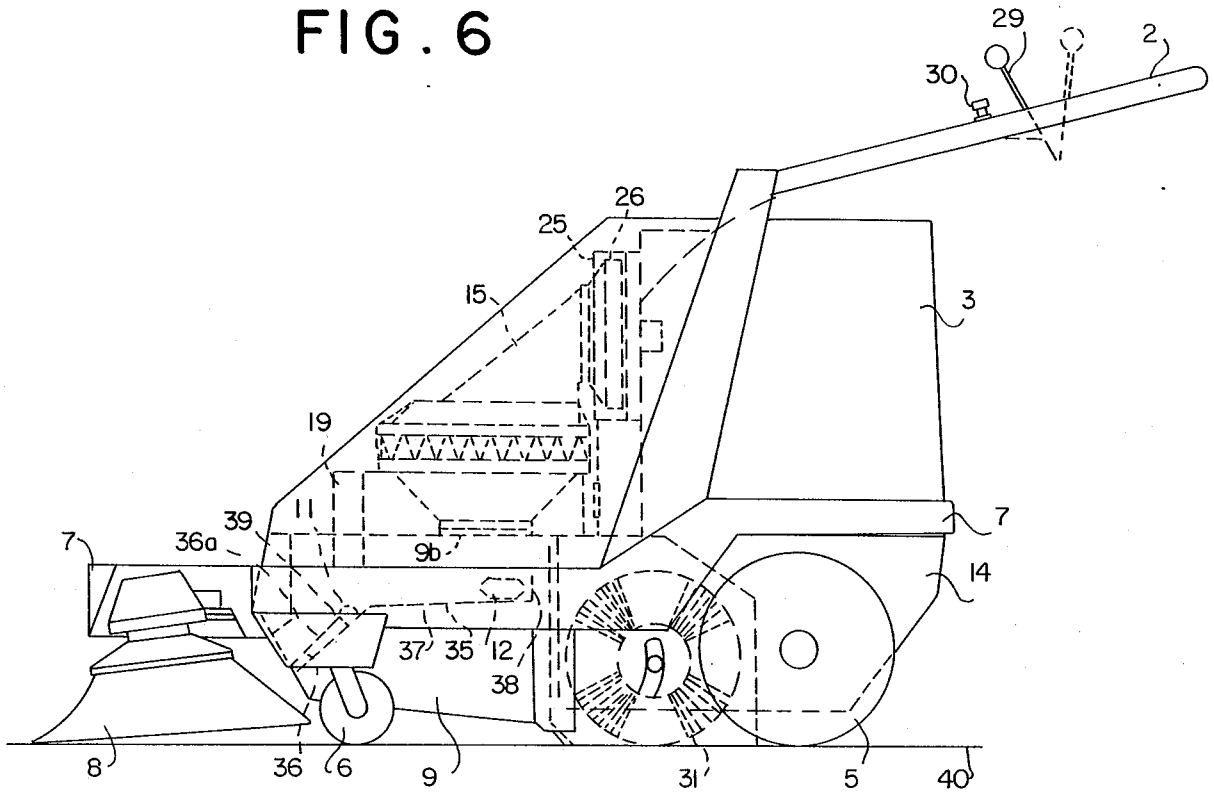
FIG. 6 is a more complete schematic side view of the sweeping machine of FIGS. 1 and 2, showing, inter alia, a guide and mount for the dirt hopper.

Referring now to FIGS. 1, 2 and 6, a hand-guided sweeping machine 100 in accordance with the present invention, includes a machine frame 1, a detachable hopper 9, a filter housing 15, a blower housing 25 and blower 26 and a rotatable cylindrical brush 31. Frame 1 is also provided with respective pairs of wheels 5 and 6 (attached to frame 1 in a conventional manner, not shown) and supports a suitable drive mechanism (not shown), such as a conventional battery-driven electric motor or an internal combustion engine, disposed within a drive housing 3. In addition, a removable cover lid 4 is disposed on frame 1 over hopper 9, filter housing 15, blower housing 25, and an undercasing 14, is suitably mounted on frame 1 inwardly of wheels 5, to cover the back, front and sides of cylindrical brush 31. If desired, a conventional rotating disk broom 8 may be provided at the front of sweeping machine 100 on a swingable arm 7.

Frame 1 suitably includes respective generally horizontal forward support members 1*a*, vertical columns 1*b*, and generally horizontal rear supports 1*c*. Forward support members 1*a* are provided with a slide track 35 (FIG. 6; not shown in FIGS. 1 and 2), a generally vertical support member 19 and a strut 21 (FIG. 6). As will hereinafter be more fully described, hopper 9 includes respective pairs of oppositely directed projections 11 and 12 which cooperate with tracks 35 and are removably received between forward support members 1*a*. Vertical supports 19 extend a predetermined height above the top of hopper 9, when hopper 9 is in place on tracks 35.

A handlebar 2, by which the operator guides sweeper 100, is affixed to the upper portion of vertical columns 1*b*, extending to the rear of sweeper 100. A cross strut 32 is provided across handlebar 2 in which, respective control devices such as a filter tilt control lever 29, a main drive switch 30, and direction control lever 33.

Figure 3:
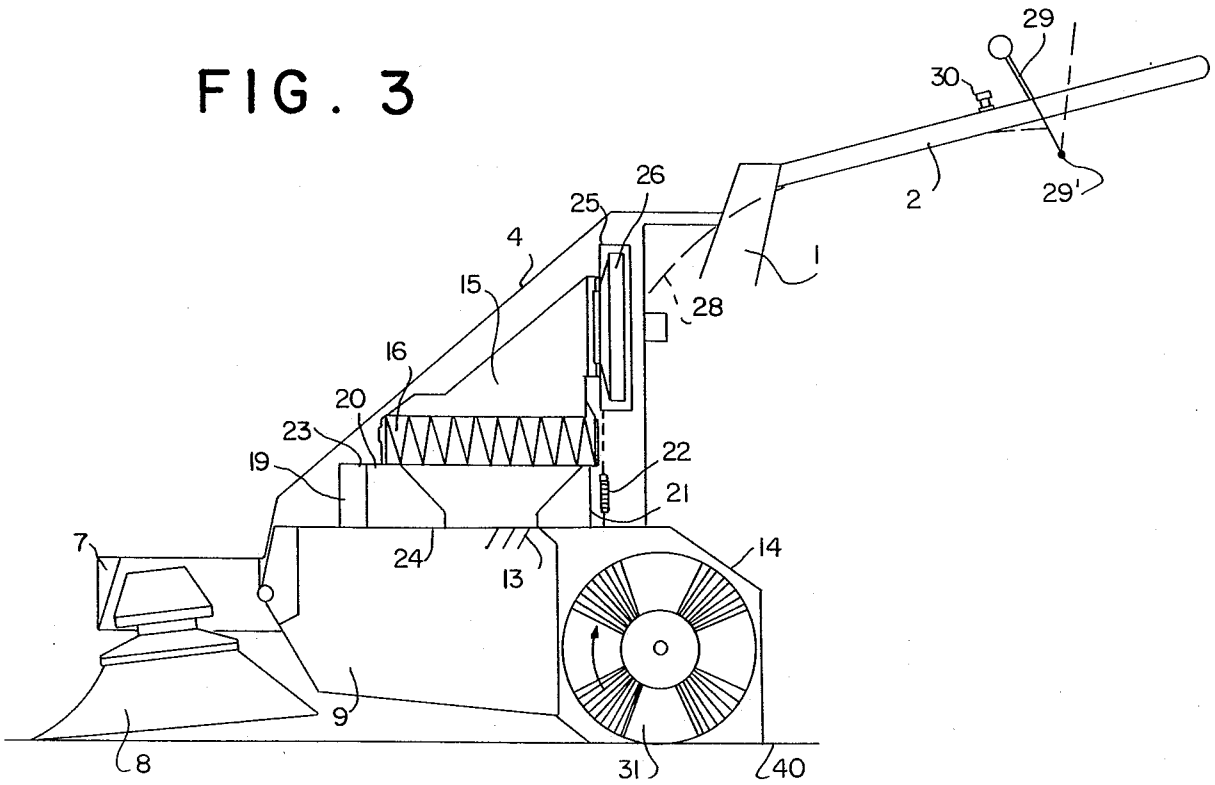
FIG. 3 is a simplified schematic side view of the sweeping machine of FIGS. 1 and 2, with the filter housing in its lowered position.

Referring briefly to FIGS. 2, 3, 6 and 7, hopper 9 is preferably generally box-shaped and includes a relatively large rear aperture (opening) 9*a*, and an upper opening 9*b* (FIGS. 3 and 6). Respective spaced apart guideplates 13 (FIGS. 2 and 3) extend across upper opening 9*b*. Plates 13 are generally rectangular in shape and are inclined downwardly towards the front of hopper 9 for directing dirt therein. Pairs of respective forward and rear projections 11 and 12 are provided on the vertical sidewalls 9*c* of hopper 9, adapted to cooperate with tracks 35, to facilitate mounting. Projections 11 are generally cylindrical and have a predetermined diameter. Projections 11 are disposed on sidewalls 9*c* at predetermined distances from the front and bottom of hopper 9. Projections 12 are generally eliptical in cross section, and are larger in cross section than projections 11. Projections 12 are disposed at predetermined distances from the rear and bottom of hopper 9, somewhat higher than projections 11. If desired, a handle 10 may be provided in the front wall of hopper 9 to facilitate insertion and removal. When fully inserted along tracks 35, hopper 9 is disposed with rear opening 9*a* proximate to cylindrical brush 31. Rear opening 9*a* may include a flap 57 which trails along the ground and ensures that dirt and dust are swept up by brush 31 into hopper 9.

Figure 4:
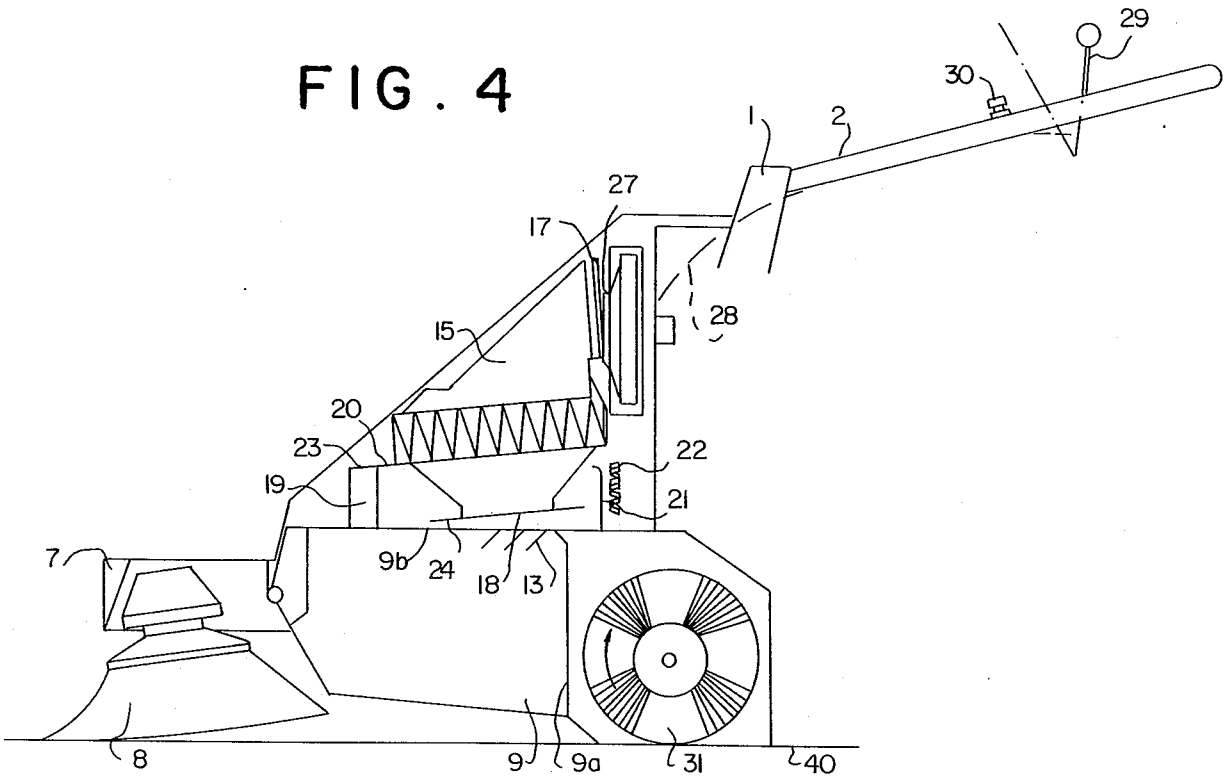
FIG. 4 is a simplified schematic side view of the sweeping machine of FIGS. 1 and 2 with the filter housing in the raised position.

When brush 31 is rotated in a clockwise direction as indicated in FIGS. 3, 4 and 6, dirt and debris on a floor 40 are propelled through rear opening 9*a* into hopper 9. It should be appreciated that brush 31 may also be rotated in a counterclockwise manner to propel dirt from floor 40 over its upper edge through the rear opening 9*a* into hopper 9.

Figure 5:
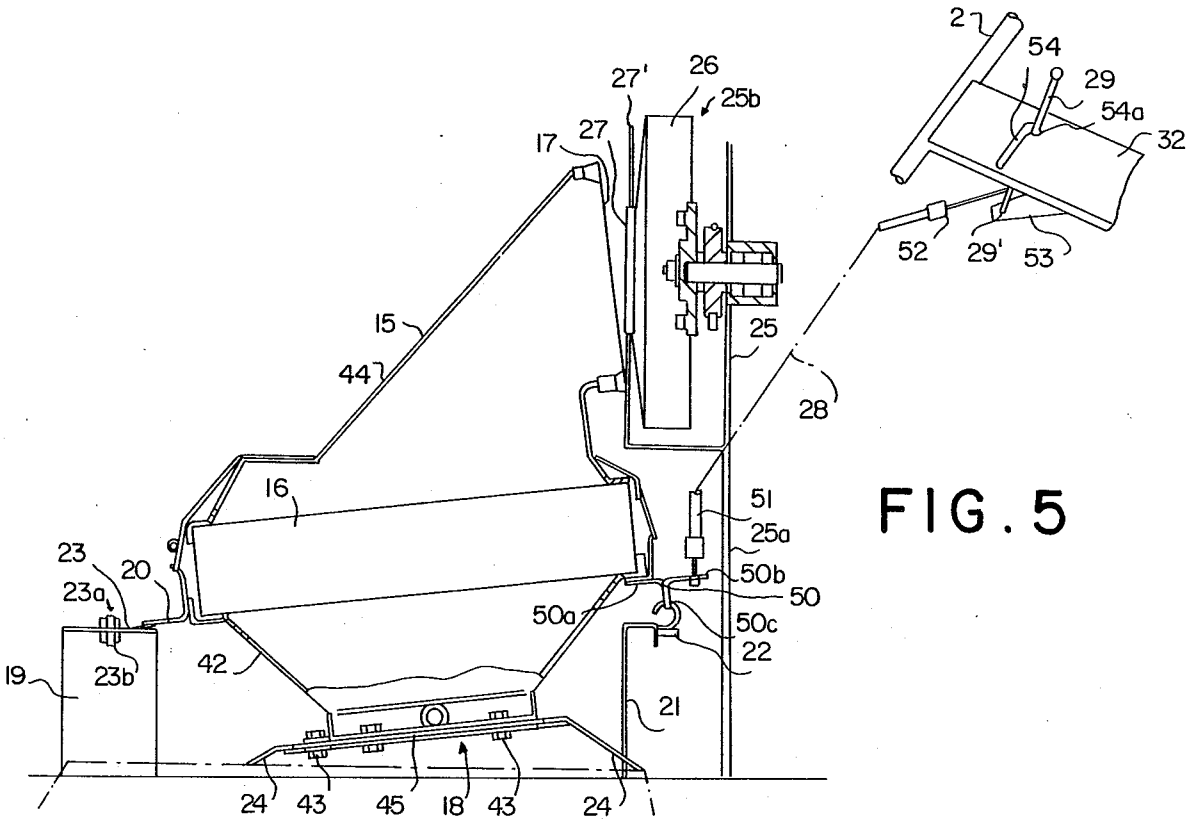
FIG. 5 is a schematic side view of the filter housing in the raised position.

Referring now to FIGS. 2 and 5, blower 26 is suitably mounted within blower housing 25, which suitably includes a rear vertical mounting wall 25*a* in which blower 2*c* is mounted, and a compartment 25*b*. Compartment 25*b* suitably includes a blower intake aperture 27, disposed in a forward stationary wall 27′ of compartment 25*b*.

Filter housing 15 is disposed to controllably provide a suction flow path from hopper 9 to blower 26, through a conventional filter 16. Referring now to FIG. 5, filter housing 15 suitably comprises lower and upper sections 42 and 44, between which filter 16 is disposed, and an interconnecting peripheral framework 20. Filter 16 is suitably box-shaped and of greater planar dimensions than hopper upper opening 9*b*. A lower peripheral edge of upper section 44 conforms in peripheral shape to, and is received about, filter 16. A filter housing outlet opening 17 is disposed at the other end of housing section 44. If desired, a resilient sealing ring 17*a* can be disposed about the periphery of outlet 17.

Lower section 42 similarly has an upper lip generally conforming in peripheral shape to, and adapted to receive, filter 16. Lower section 42 tapers inwardly to ultimately define a filter housing inlet opening 18 of approximately the dimensions of hopper upper opening 9*b*.

Framework 20, which holds together lower and upper sections 42 and 44, is disposed about the periphery of filter 16 and overlies, or is otherwise affixed to, portions of both housing sections 42 and 44. When filter housing 15 is installed, outlet 17 is perpendicularly disposed relative to inlet 18 and laterally offset to the rear thereof.

A flanged frame 45 is affixed to lower housing section 42 about inlet 18. Frame 45 suitably includes respective halves, held together by screws 43, between which the periphery of a continuous sealing flap 24, suitably formed of a resilient material such as rubber or flexible plastic, is clamped. Sealing flap 24 extends continuously around inlet 18.

Filter housing 15 is pivotally mounted on support members 19 above hopper 9. A suitable hinging mechanism 23*a* is coupled to a forward edge of framework 20 and fastened, suitably by screws 23*b*, to the tops of supports 19, defining an axis 23 about which filter housing 15 may be tilted. The height of support 19 is such that axis 23 is disposed at a level approximately halfway between filter housing inlet opening 18 and the lower edge of outlet opening 17. The relative disposition of supports 19 in front of housing 9 is such that the distance of axis 23 from the center of housing inlet 18 is significantly less than the distance to the plane of outlet 17. The distance from axis 23 to the center of inlet 18 is suitably only approximately one-half to two-thirds of the distance from axis 23 to the center of outlet 17.

Strut 21 is mounted on frame 1 on the opposite side of filter housing 15 from supports 19, disposed to support housing 15. Filter housing 15 is biased against strut 21 (and blower housing 25) by a conventional tension spring 22. As will be explained, spring 22 cooperates with an actuation mechanism through which the operator can tilt filter housing 15.

Referring again to FIGS. 2 and 5, tilt control lever 29 on handlebar cross strut 32 is connected to filter housing 15 through a suitable actuation mechanism 28, such as, for example, a Bowden cable or a rod. A support plate 53 is disposed on the underside of cross strut 32. Tilt lever 29 is pivotally attached to plate 53, and extends through an L-shaped guiding slot 54. One end 52 of the actuation mechanism (e.g. cable or rod) is coupled to lever 29 between pivot point 29' and cross strut 32. The other end 51 of actuating mechanism 28 is connected to the rear of filter housing 15, suitably through a T-shaped plate 50 which is secured to support frame 20 and is connected to spring 22. Connector 50 has a pair of arms **50*a*, 50*b* and a stem 50*c*. Arm 50*a* is secured to filter housing 15. Arm 50*b* is connected to end 51 of mechanism 28, and stem 50*c* is connected to one end of spring 22. When lever 29 is in a rearward position within slot 54, actuating mechanism 28, operating against the bias of spring 22, pulls the rear of filter housing 15 up so that it lifts off from support strut 21 and pivots about axis 23**.

Blower 26 generates a suction to facilitate pickup of dust and small particles freed by cylindrical brush 31. However, under some operating conditions, suction may not be desirable. For example, if damp dirt, or light granules, e.g., of polystyrene, are to be taken up by the sweeping machine 100, suction may not be desirable. However, it may also be desirable for blower 26 to continue to run. Under some circumstances, it is desirable to interrupt the suction without deactivating blower 26. For example, blower 26 may be employed to assist in cooling the drive mechanism.

Suction control, not requiring deactivating blower 26, is provided by moving filter housing 15 into first (untilted) or second (tilted) positions, to selectively provide or break the suction air path between hopper 9 and blower 26.

To provide suction, filter housing 15 is disposed in the first (untilted) position (shown in FIGS. 2, 3 and 6). In this position, housing 15 rests on strut 21, with housing inlet 18 generally in registry with hopper upper opening **9*b*, and housing outlet 17 in general registry with blower inlet 27. Sealing ring 17*a* of filter housing 15 surrounding outlet 17 fits against wall 27' of blower housing 27 to create a seal. Likewise, sealing flap 24 (not shown in FIG. 2) provides a seal about hopper upper opening 9*b* and filter housing inlet 18. With filter housing 15 in this position, blower 26 produces a current of air through openings 9*a* and 9*b* of hopper 9, filter housing inlet 18, filter 16, and filter housing outlet 17, and finally through blower 26. Dust and small particles thrown up by brush 31 are collected on filter 16**.

To interrupt suction, filter housing 15 is tilted into the position illustrated in FIGS. 4 and 5, creating a gap between filter housing outlet 17 and the blower intake opening. Referring to FIG. 5, to retain filter housing 15 in the tilted position, operating lever 29 is moved rearwardly in slot 54 until it is engaged in a locking foot **54*a* of the slot and thus maintained in the rearward position. The rearward movement of lever 29 causes actuation mechanism 28 to lift the rear of filter housing 15 against the force of spring 22, tilting housing 15 about axis 23. This causes a gap to be formed between filter housing outlet opening 17, and intake opening 27 of blower 26**, interrupting the closed air path.

A gap is similarly created between hopper upper opening **9*b* and filter housing inlet 18. Flanged frame 45 assumes a disposition sloping upwardly from the front to the rear. However, while the movement of flanged frame 45 results in deformation of sealing flap 24, sealing flap 24 is sufficiently flexible and elastic and of sufficient dimensions to maintain a sealing contact with the upper wall of hopper 9 circumscribing upper opening 9*b*. Thus, blower 26 remains isolated from the dust and particles raised by brush 31**.

The gap between filter outlet opening 17 and blower intake opening 27 causes blower 26 to draw air from the surrounding area through the gap, rather than through filter housing 15. Accordingly, with the closed air path disrupted, there is no suction.

To restore suction, the operator moves operating lever 29 out of the locking foot of guide slot 54, and filter housing 15, by its own weight and the biasing force of spring 22, returns to the untilted position. Filter housing 15 moves downwardly into its untilted registry position, and at the same time, actuating mechanism 28 causes lever 29 to move forwardly in slot 54.

Collected dirt can readily be dislodged from filter 16 by moving lever 29 back and forth inside guide slot 54 without engaging the locking foot **54*a* of guide slot 54, causing filter housing 15 to correspondingly tilt up and down on axis 23 and strike against strut 21. A sharp shock occurs upon each impact of housing 15 on strut 21, dislodging dirt from filter 16 and causing it to fall through housing inlet opening 18 into hopper 9. Since sealing flap 24 continues to surround and provide a seal between housing inlet 18 and hopper upper opening 9*b*, and housing inlet 18 continues to generally overlie opening 9*b*, blower 26 is effectively isolated from the dust and particles loosened by the bouncing of filter housing 15, and the dislodged particles are received in hopper 9. Further, the forward incline of guide plates 13 direct the dislodged particles towards the front of hopper 9 and away from rear opening 9*a*. Thus, the risk of the dislodged particles escaping through hopper rear opening 9*a*** is reduced.

As previously noted, hopper 9 is mounted between forward side supports **1*a* of machine frame 1, and can be removed from, and reinserted into, sweeping machine 100 from the front. Referring to FIG. 6, projections 11 and 12 on the side walls of hopper 9 cooperate with track guides 35 on each of forward side supports 1*a*. Each track 35 includes a downwardly inclined, front portion 36, a generally horizontal (slightly inclined) middle portion 37, and an upwardly angled end portion 38. Inclined front portion 36 extends downwardly to a distance from the ground which is less than the distance of the lower surfaces of projections 11 and 12 from the bottom of hopper 9. Middle portion 37 of track 35 is disposed at a distance from the ground greater than the distance from projection 12 to the bottom of hopper 9. Inclined front portion 36 includes a projection surface 36*a*, running obliquely forward from the lowest point of front portion 36 and extending upward to a point proximate the junction of front portion 36 with middle portion 37 slightly below the level of middle portion 37. A recess, e.g., gap 36*b*, is thus formed in the vicinity of forward portion 36, and the juncture of track portions 36 and 37. At its mouth, the gap 36*b* (at the level of middle portion 37), is of a width slightly greater than the diameter of projections 11, but preferably less than the corresponding dimension of projections 12**, and gradually decreases in width.

Figures 7, 8:
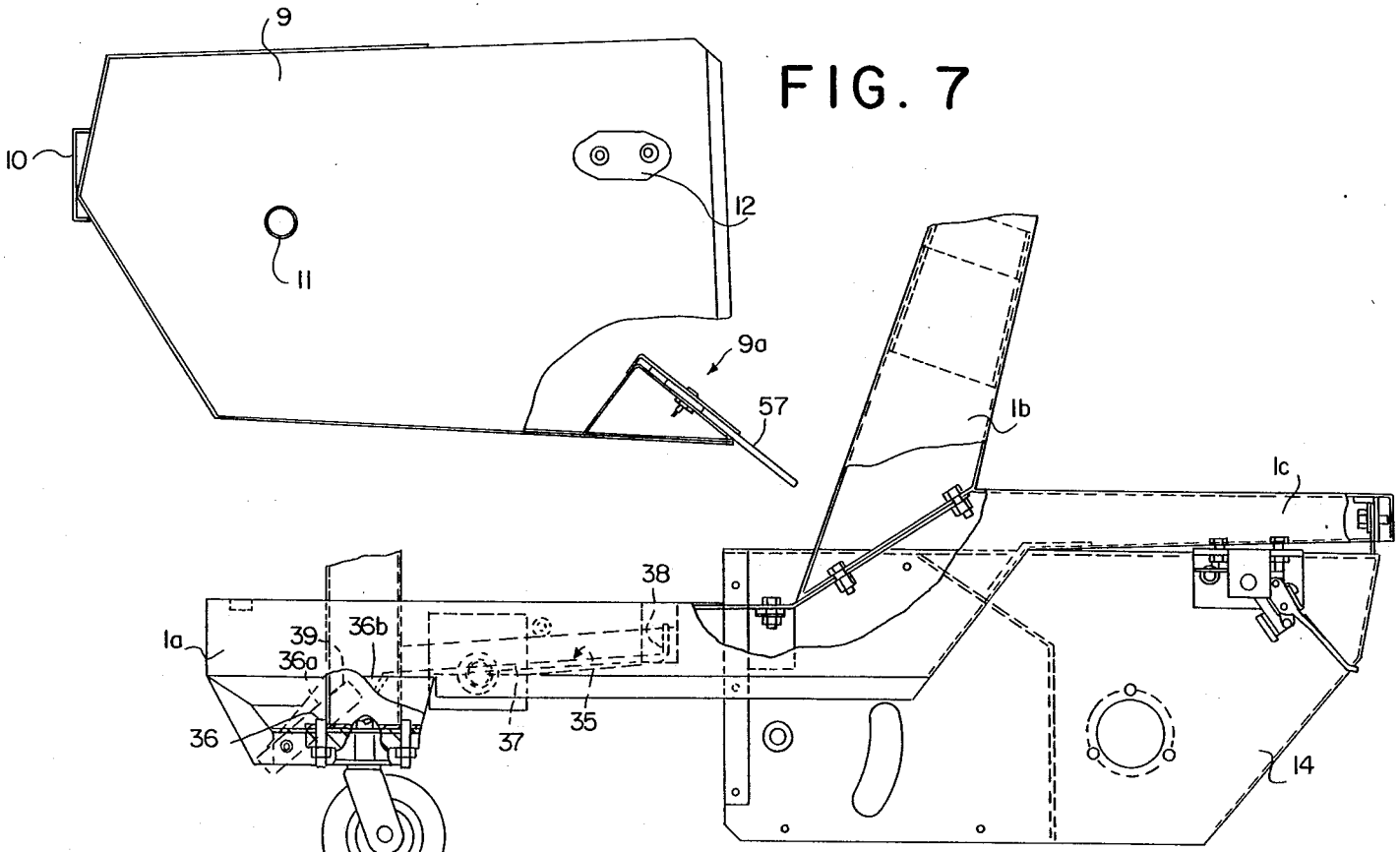
FIG. 7 is a side elevational view, partly broken away, of a hopper according to the invention.
FIG. 8 is a partial side elevational view, partly broken away, of the frame and hopper guide track assembly of FIG. 6.

Referring to FIG. 8, portions 37, 38 of track 35 may comprise a generally Z-shaped rail mounted at one edge to the interior of forward frame portion **1*a*. Forward portion 36 comprises a separate, generally rectangular plate secured face-to-face with the interior of frame portion 1*a*. Surface 36*a* is a side edge of plate 36, and gap 36*b* is a notch defined between a downturned end of rail 37, 38 and an upper edge of plate 36**.

When hopper 9 is received in machine 100, the lower surface of each rear mounting projection 12 is disposed on the corresponding middle portion 37 of the associated track 35, abutting against angled rear portion 38, and each front projection 11 is received in the gap at the juncture of forward portion 36 and middle portion 37 of track 35. Track 35 is disposed so that hopper 9, with projections 11 and 12 engaged in track 35, is disposed off of ground 40 with rear opening **9*a* proximately adjacent brush 31**.

Hopper 9 is easily removed for emptying from the front of machine 100, without exposing blower 26 to dust. Arm 7 with disk broom 8, if present, is swung upwards to provide clearance. Hopper 9 is lifted slightly, suitably using grip 10 (See FIG. 2), to cause projection 11 to disengage and clear projection surface **36*a* of guide track 35. Projections 11 then slide down projection sufrace 36*a*. Hopper 9 can then be pulled forward, with projections 12 sliding on middle portion 37 of track 35, then over the upper end 39 of projection surface 36*a* of front portion 36. Since the dimensions of projections 12 are larger than the gap at the juncture of front portion 36 and middle portion 37, the gap does not hinder smooth removal; projections 12 slide readily over the gap. If desired, once the front of hopper 9 can be placed in contact with the ground, relative movement can be provided by backing machine 100** away from the hopper, rather than by pulling the hopper.

It should be appreciated that the removal process does not require, and in fact militates against, hopper 9 being significantly tilted toward rear opening **9*c***. Thus, inadvertant spillage is minimized.

Further, to the extent dust is raised during the removal process, blower 26 remains isolated by filter 16. During removal, filter housing 15 is normally in the lowered position (FIGS. 3 and 6) with blower 26 protected from dust by filter 16. As hopper 9 is removed, sealing flap 24 slides over the upper wall of hopper 9.

To reinsert hopper 9, hopper 9 is placed on the ground in front of machine 100. Machine 100 is then moved toward hopper 9, causing projections 12 to engage the front surfaces of corresponding projection surfaces **36*a*, sliding over surfaces 36*a* and into middle portions 37 of guide tracks 35. As projections 12 slide on middle portions 37 toward angled portions 38, forward motion of machine 100, causes projections 11 to ultimately engage surface 36*a* and similarly slide over front track portions 36 until projections 11 slip over projection surfaces 36*a* and enter in the gaps. Projections 12 abut against angled rear portions 38, thus securing hopper 9 in machine 100. As hopper 9 moves rearward and upward on track 35, the upper surface of hopper 9 is brought against sealing flap 24, which ultimately again assumes a sealing relationship about upper opening 9*b***.

It will be understood that the above description is of a preferred exemplary embodiment of the present invention, and that the invention is not limited to the specific form shown. For example, first portions 6 and middle portions 37 of tracks 35 are claimed and described as extenders along substantially straight lines. However, if desired, track portions 36 and 37 curved. Further, in the embodiment described, projections 11 are received in gaps formed between projection surface **36*a* and the junction of track portions 36 and 37 to releasably secure hopper 9 on tracks 35. However, if desired, a recess or indentation of dimensions in accordance with the diameter of projection 11, otherwise formed in the surface of track 35 may be employed to receive projections 11**. These and other modifications may be made in the design and arrangement of the elements within the scope of the invention as expressed in the appended claims.

We claim:

1. A sweeping machine of the type including: a rotary brush; a detachable hopper; and means for receiving said hopper in a predetermined relative disposition to said rotary brush to receive particles propelled by said brush; improved wherein said means for receiving said hopper comprises respective oppositely directed sets of first and second projections, each set disposed on an opposing side of said hopper; the first projection of each set being disposed on the said opposing hopper side at a first predetermined elevation, and the second projection of each set being disposed on said opposing hopper side spaced apart from said first projection and at a second predetermined elevation; and opposing tracks disposed in predetermined relation to said brush to engage said projections, each of said tracks including first and second portions, said first portion being disposed for initial engagement with said projections, and extending inwardly from a third predetermined elevation to a fourth predetermined elevation adjacent said second portion, said third predetermined elevation being less than said first and second predetermined elevation, and said fourth predetermined elevation being greater than said first and second predetermined elevation, said second portion extending inwardly from approximately said fourth predetermined elevation, adjacent said first portion to a a fifth predetermined elevation.

2. The sweeping machine of claim 1 wherein said second predetermined elevation is greater than said first predetermined elevation.

3. The sweeping machine of claim 1 wherein said fifth elevation is approximately equal to said fourth predetermined elevation.

4. The sweeping machine of claim 1 wherein said means for receiving said hopper further includes means for releaseably engaging said first projections to secure said hopper on said tracks.

5. The sweeping machine of claim 4 wherein said means for releaseably engaging comprises a recess disposed in said track in the vicinity of the juncture of said first and second portions, said recess being of sufficient extent to admit said first projection.

6. The sweeping machine of claim 5 wherein said second projections are of an width greater than the maximum width that will be admitted by said recess.

7. The sweeping machine of claim 1 wherein said track first portion includes a projection surface disposed to form a gap in the vicinity of the juncture between the same track first and second portions, said gap being of a width sufficient to admit said first projection.

8. The sweeping machine of claim 6 wherein said second projections are of a width greater than the maximum width that will be admitted by said gap.

9. The sweeping machine of claim 1 wherein said first and second portions extend along substantially straight lines.

10. A sweeping machine of the type including: a body; a rotary brush; a detachable hopper including rear and upper openings; means for receiving and detachably securing said hopper to said body in predetermined relation to said brush such that said rear opening is disposed for receiving said particles propelled by said brush; a blower, having a blower intake, for generating an air stream; a filter housing having inlet and outlet openings disposed to communicate, when said hopper is secured in said predetermined relation with said brush, with said hopper upper opening and said blower intake, respectively, said machine being improved wherein said means for receiving and detachably securing said hopper comprises:

means for slideably engaging the sides of said hopper to lift said hopper in response to relative movement between said hopper and said body in a predetermined direction, ultimately bringing said hopper into said predetermined relation with said brush, and said hopper upper opening into communication with said filter housing inlet, and wherein said means for slideably engaging the sides of said hopper comprises respective, oppositely directed sets of first and second projections, each set disposed on an opposing side of said hopper, the first projection of each set being disposed on said opposing hopper side at a predetermined distance from the bottom of said hopper, and the second projection of each set being disposed on said opposing hopper side rearwardly disposed relative to said first projection and at a second predetermined distance from the bottom of said hopper; and opposing tracks disposed on said frame to slidingly engage said projections, each of said tracks including first and second portions, said first portion being disposed for initial engagement with one of said second projections in response to said relative movement between said hopper and said frame, said first portion sloping upwardly from a height below said first and second predetermined distances to a height greater than said first and second distances in the vicinity of said second portion;

said second portion being disposed adjacent said first portion between said first portion and said brush, and sloping upwardly to a lesser extent than said first portion.

11. The sweeping machine according to claim 10 wherein said first predetermined distance is less than said second predetermined distance.

12. The sweeping machine according to claim 10 wherein said track second portion is generally parallel to the ground.

13. The sweeping machine according to claim 10 wherein said means for slideably engaging further includes means for releaseably engaging said first projections to secure said hopper on said tracks.

14. The sweeping machine of claim 13 wherein said means for releaseably engaging comprises a recess disposed in said track in the vicinity of the juncture of said first and second portions, said recess being of sufficient dimension to admit said first projection.

15. The sweeping machine of claim 14 wherein said second projection is of dimensions greater than will be admitted by said recess such that said second projection slides over said recess in response to said relative movement.

16. The sweeping machine of claim 13 wherein said track first portion includes a projection surface disposed to form a gap in the vicinity of the juncture between track first and second portions, said gap being of dimensions sufficient to admit said first projection.

17. The sweeping machine of claim 16 wherein said second projections are of dimensions greater than will be admitted by said gap, such that said second projection slides over said recess in response to said relative movement.

18. The sweeping machine of claim 10 further including means, including a flap of resilient material surrounding said housing inlet, for effecting a seal between said filter housing inlet and said hopper upper opening when said hopper is secured in said predetermined relation with said brush.

19. The sweeping machine of claim 10 wherein said rotary brush is cylindrical and disposed for rotation about an axis, and said predetermined direction is generally perpendicular to said brush axis.

* * * * *